United States Patent [19]

Rochlitz et al.

[11] 4,026,704

[45] May 31, 1977

[54] ELECTROPHOTOGRAPHIC RECORDING MATERIAL

[75] Inventors: Jurgen Rochlitz, Wiesbaden; Richard Lehner, Wiesbaden-Erbenheim, both of Germany

[73] Assignee: Hoechst Aktiengesellschaft, Germany

[22] Filed: Aug. 12, 1975

[21] Appl. No.: 604,041

Related U.S. Application Data

[63] Continuation-in-part of Ser. No. 312,268, Dec. 5, 1972, abandoned.

[30] Foreign Application Priority Data

Dec. 8, 1971 Germany ..... 2160812

[52] U.S. Cl. ..... 96/1.5; 96/1.6

[51] Int. Cl.[2] ..... G03G 5/06

[58] Field of Search ..... 96/1.6, 1.5; 252/501

[56] References Cited

UNITED STATES PATENTS

| | | | |
|---|---|---|---|
| 3,549,358 | 12/1970 | Clecak | 96/1.5 |
| 3,598,582 | 8/1971 | Herrick | 96/1.5 |
| 3,884,691 | 5/1975 | Rochlitz | 96/1.5 |
| 3,898,084 | 8/1975 | Champ et al. | 96/1.5 |

*Primary Examiner*—Edward C. Kimlin
*Assistant Examiner*—John L. Goodrow
*Attorney, Agent, or Firm*—James E. Bryan

[57] ABSTRACT

This invention relates to an electrophotographic recording material comprising an electrically conducting carrier and a photoconducting laminate thereon, the latter comprising a base layer and a top layer each containing an organic photoconductor, binder and sensitizer, at least one organic photoconductor being common to both of said top and base layers and the base layer containing a bisazo dyestuff.

7 Claims, 1 Drawing Figure

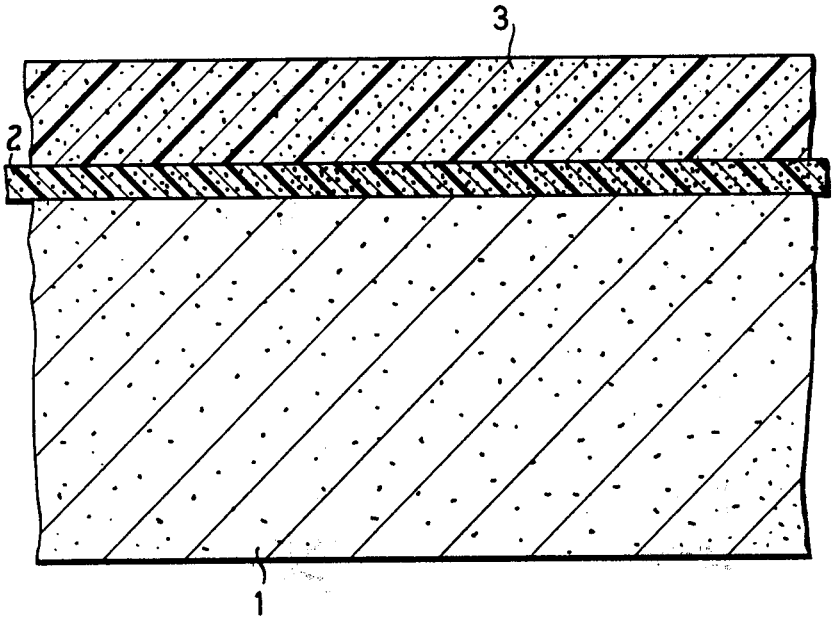
3
2
1

ELECTROPHOTOGRAPHIC RECORDING MATERIAL

This application is a continuation-in-part of application Ser. No. 312,268, filed Dec. 5, 1972, now abandoned.

The present invention relates to an electrophotographic recording material of an electrically conducting carrier and an applied photoconducting double layer consisting of a top layer and base layer and containing a photoconductor, a binder, a sensitizer and, if desired, the usual additives.

The most diverse proposals for the manufacture of multi-layer, especially of double-layer, photoconducting insulating material in combination with an electrically conducting carrier already have been made. Thus, it has been proposed, in order to avoid the coloration of zinc oxide paper by colored sensitizers, to provide the carrier with two superposed photoconducting layers of which only the upper layer is sensitized with a dyestuff. It is known that by means of such an arrangement of the layers a slight improvement of the sensitivity over the more colored single layer is achieved. It has, however, been found that these layers with an inorganic photoconductor are unsuitable for an electrophotographic copying process in which several thousand copies are to be manufactured from a photoconductor surface.

It also has been proposed to use double layers with selenium as the photoconductor in a base layer or top layer, in combination with further photoconductors or sensitizers. Thus, selenium is provided with a sensitizer on both sides. Here it has been found that the outermost sensitizer layer is mechanically unstable in that it is easily worn away and diminishes the light intensity reaching the lower dyestuff layer, through an additional filter effect.

Furthermore, a photoconducting selenium layer may be provided in combination with either an intermediate layer or an external phthalocyanine layer. The latter, in particular, shows a great mechanical instability. Selenium layers have to be manufactured by relatively expensive vacuum vapor deposition, and it is also found that the adhesion between the heterogeneous constituents is unsatisfactory because of their different nature. Additionally, the sensitivities of such layers show relatively little increase over the photoconductors applied as a single layer.

Photoconducting double layers of organic materials on a carrier already have been proposed. In this case, for example, a photoconducting layer is produced from an organic photoconductor, a dyestuff and a hydrophobic polymer and the solution of a sensitizing dyestuff is applied to the surface of this photoconducting layer, if necessary several times, and the solvent is evaporated. The filter effect already described is, however, a disadvantage and the mechanical stability of the layer applied is low because of the inadequate cohesion and adhesion of the sensitizer applied. Furthermore, only a relatively slight increase in sensitivity is achieved.

Finally, it also has been proposed to increase the sensitivity by manufacturing a recording material with a photoconducting layer as a double layer of organic constituents, containing a sensitivity-increasing dyestuff in a binder between the carrier and its transparent light-sensitive layer. This again has the disadvantage of little matching of the materials to one another so that unsatisfactory adhesion and only a relatively slight increase in sensitivity result.

The present invention provides a highly sensitive photoconductor laminate in which the adhesion between the various layers is satisfactory and wear phenomena are reduced.

The invention accordingly provides an electrophotographic recording material comprising an electrically conducting carrier and a photoconducting double layer applied thereto, the double layer consisting of a top layer and a base layer and containing photoconductor, binder, sensitizer and optionally further customary additives, in which the same organic photoconducting substance is present in the top layer as in the base layer and a bisazo dyestuff sensitizer is present in the base layer. The photoconducting substance is preferably present in the top layer in an amount of 40 – 60 percent by weight and in the base layer in an amount in the range of between 5 and 10 percent by weight, relative to the individual layers, and the bisazo dyestuff is present in the base layer in an amount in the range of about 20 – 90% by weight relative to the weight of the base layer. The top layer and the base layer preferably contain the same binder.

The result of this is that increases in sensitivity of up to five times that of the single photoconductor layer are achieved. Furthermore, there is good adhesion between the layers, especially if the same binder is used in the top layer and the base layer.

The photoconducting double layer according to the invention contains a relatively high concentration of bisazo dyestuff in the base layer, which results in intense color cover. The top layer contains only a low concentration of a sensitizer or has no added sensitizer. As a result, adequate transparency of the top layer is achieved in every case.

An organic photoconducting substance is considered to be suitable according to the invention if it is a substance which can easily release an electron and is therefore suitable for defect electron transport.

Accordingly, photoconducting substances used are organic monomeric or polymeric photoconductors, especially heterocyclic or carbocyclic compounds which possess at least two substituted amino groups or at least three ether groups directly on the aromatic system. Other substances which are very suitable are, for example, polyvinyl carbazole, copolymers of vinyl carbazole, and compounds of the pyrene, perylene and anthracene series. The use of 2,5-bis-(p-diethylaminophenyl)-1,3,4-oxdiazole, which in the form of a layer shows particularly high sensitivities if the layer is negatively charged, is especially preferred.

Examples of binders employed according to the invention are polymers or copolymers of vinyl chloride, vinylidene chloride, styrene, acrylic acid esters and vinyl ethers, and also polyester, polycarbonate or polyurethane resins, by themselves or as mixtures.

Polymers or copolymers with an electron acceptor function are preferentially used, for example those which contain halogen, especially chlorine, or anhydride, ester or amide groups, which ensure effective defect electron transport via the photoconductor molecules. These substances especially include copolymers of styrene and maleic anhydride, copolyesters of isophthalic and terephthalic acid and ethylene glycol, polycarbonates or post-chlorinated polyvinyl chloride.

By activating sensitizers which are employed in the base layer there are to be understood only those which permit reaction 2, indicated below. Examples of substances which have proved very successful here are bisazo dyestuffs which carry electron-attracting groups; these include the Naphthol(R) A-S dyestuffs (Bayer, Farbwerke Hoechst). Further exemplary bisazo dyestuffs are Diana Blue (Color Index - 2nd Edition, 1956 - 21,180), Pigment Red 39 (C.I. 21,080) and Pigment Red 42 (C.I. 21,210), and a dyestuff like Diana Blue (C.I. 21,180) with methyl groups instead of the methoxy groups. The activating sensitizers are here employed individually or as mixtures.

Furthermore, depending on the requirements of individual cases, generally used color sensitizers can be added to the organic photoconductor to increase the sensitivity or to regulate the spectral sensitivity properties. As additives it is possible to use, for example, plasticizers such as triphenyl phosphate or flow control agents such as silicone oils.

As electrically conducting carriers it is possible to use all bases which meet the requirements of electrophotography, i.e., for example, metal plates or metallized glass plates, paper or sheets of electrically conducting resins or metallized sheets.

The thickness of the top layer is advantageously from 2 to 20 $\mu$m, thicknesses between 7 and 15 $\mu$m being preferred. The base layer is advantageously from 0.1 to 5 $\mu$m thick, thicknesses of 0.2 to 2 $\mu$m, depending on the dyestuff, having proved particularly successful.

A recording material according to the invention is schematically reproduced in the accompanying DRAWING. In the drawing, the material comprises an electrically conducting carrier 1, a base layer 2 and a top layer 3.

The photoconducting double layers are obtainable by lamination of two photoconductor layers manufactured in accordance with customary coating processes. They are, however, also obtainable by two-fold coating of the carrier layer in accordance with known processes, which is at times technically more advantageous, though care must be taken that the second coating should as far as possible not cause the base layer to start to dissolve to a measurable extent.

The base layer serves to produce charge carriers. The high extinction of the dyestuff permits a high concentration of excited dyestuff molecules. As a result of the invention it is possible for the excited dyestuff molecule $S^x$ to react with a molecule unit of the binder or with the photoconductor molecule F to form charge carriers:

1. $S + h\nu \rightarrow S^x$
2. $S^x + F \rightarrow .S^- + .F^+$

In the case of the known layers this would be possible only in a very thin boundary layer immediately at the transition between the two layers. If the layer is negatively charged the dyestuff molecules participate in the electron transport in that electrons are transiently bonded to them (as the radical anions of the dyestuff molecule $.S^-$); on the other hand, the photoconductor molecules are responsible for defect electron transport in that they transiently lack an electron (radical cations of the photoconductor molecules $.F^+$).

The advantage of the invention arises from the fact that by such a favorable combination of photoconductor and activating sensitizer and by mixing in the thin base layer, in accordance with the invention, a high sensitivity is achieved, sensitivity being understood as the ability to lose as rapidly as possible an electrostatic charge of this double layer on exposure to light. Furthermore, such a layer has far less tendency to fatigue during long copying times; i.e., the sensitivity and the charge level in the dark remain constant, which is not the case, without special measures, in the case of known double layers and other materials.

A further advantage of the invention is that the adhesion of the layers is particularly good because the components of the two layers are similar.

The recording material according to the invention is used in electrophotographic copying machines in which such a double layer can be repeatedly re-used.

The invention is explained in more detail with the aid of the examples.

The substances mentioned are dissolved or dispersed in the indicated solvents and these solvents are converted into homogeneous films on known coating apparatus. In doing so, either the double arrangement was produced by lamination of two single layers (method A) or the double layer was produced by a double coating (method B). These double layers were then present on a conducting aluminum layer, obtainable by high vacuum vapor deposition, which in turn had been applied to a 75 to 100 $\mu$m thick polyester carrier film (Hostaphan(R), Farbwerke Hoechst). The charge decay when exposing a charged sample to light was then measured with the aid of the Dyn-Test instrument manufactured by Messrs. ECE in Giessen, Germany. The measure of the sensitivity which was determined was a factor $f$ which indicates the multiple by which the initial charge $U_o$ is greater than the charge $U_h$ reached after 2 seconds' exposure to light; in this calculation, the dark discharge $\Delta^{U_D}$ which occurs in 2 seconds is taken into account so that $f$ is obtained as follows:

$$f = \frac{U_o}{U_h + \Delta\ U_D}$$

F-values obtained using a yellow filter with a tungsten lamp in the Dyn-Test instrument mentioned are given in the examples for comparison of the sensitivities. The higher they are, the higher is the sensitivity. In addition to the sensitivity data, the half-lives ($T_{1/2}$) of the potential decay when exposed to a Xenon lamp (XEC 150 W, Osram) which produces approximately 300 Lux in the plane of the sample, were also coated (method of Arneth and Lorenz, Reprographie 1963). The lower the $T_{1/2}$, the greater the sensitivity. Quoting both measurements makes it possible to estimate the sensitivities for a negative layer charge in the short-wavelength and long-wavelength region of the visible spectrum.

Comparison experiments are first presented to show that previously proposed layer compositions do not show significant improvements even after modifications.

Comparison experiments:

The following recording materials were manufactured by lamination (method A) of base layers and top layers, manufactured according to conventional coating procedures, on a polyester carrier on which aluminum had been vapor-deposited.

A. Electrophotographic double layers:

a. Manufacture of the base layer

A solution of 4% by weight of a copolymer of styrene and maleic anhydride (Lytron(R) of Monsanto Chemical Company, USA) in glycol monomethyl ether, with 0.5% by weight of Rhodamine B extra added, is applied and solvent is subsequently evaporated. A 1 to 2 μm thick layer results.

b. Manufacture of the top layer

A solution of 8% by weight of the synthetic resin mentioned under (a) and 8% by weight of 2,5-bis-(p-diethylaminophenyl)-1,3,4-oxdiazole in tetrahydrofuran is applied and the solvent is evaporated. A 10 to 15 μm layer results. Thereafter the layers (a) and (b) are laminated in a GBC-9 LD laminator of General Binding Corporation at 140° C. The half-life $T_{1/2}$ is determined by the indicated method to be 144 msec. The factor *f* proves to be 2.25 at a charge of −1,200 V.

Further comparison experiments with Crystal Violet instead of Rhodamine B extra in the base layer and Brilliant Green or trianisylpyrylium perchlorate in 0.1% concentration in the top layer solution as the color sensitizer give no improvement of the half-life which in each case lies in the range of 132 to 164 msec.

c. An approximately 12 μm thick photoconducting double layer made up of a 1 to 2 μm thick base layer comprising 5% weight of Diana Blue (C.I. 21,180) and 95% by weight of a copolymer of styrene and maleic anhydride (Lytron(R) 820, Monsanto) and an approximately 10 μm thick top layer made by applying and evaporating a solution of 8% by weight of Lytron 820, 8% by weight of 2,5-bis-(p-diethylamino-phenyl)-1,3,4-oxdiazole and 0.1% by weight of Brilliant Green in tetrahydrofuran gives a factor *f* of 1.4.

B. Electrophotographic single layer:

Single layers which in each case have a comparable or identical overall composition to that of double layers divided into a base layer and a top layer are used for further comparison experiments. These in particular show that far higher sensitivities are achieved in accordance with the invention.

a. A 10 μm thick single layer of a solution of 8% by weight of a copolymer of styrene and maleic anhydride (Lytron(R) 820), 8% by weight of 2,5-bis-(p-diethylaminophenyl)-1,3,4-oxdiazole and 0.1% by weight of Brilliant Green in glycol monomethyl ether gives a half-life of 360 msec and a factor *f* of 1.25.

b. A 10 μm thick single layer of a solution of 8% by weight of Lytron 820 and 8% by weight of 2,5-bis(p-diethylaminophenyl)-1,3,4-oxdiazole and 0.1% by weight of trianisyl-pyrylium perchlorate in glycol monomethyl ether gives $T_{1/2}$ = 760 msec and a factor *f* of 1.0.

c. A 10 μm thick single layer of a solution of 4% by weight of Lytron 820, 4% by weight of 2,5-bis-(p-diethylaminophenyl)-1,3,4-oxdiazole and 0.5 percent by weight of Rhodamine B extra in glycol monomethyl ether gives a half-life $T_{1/2}$ of 220 msec and a factor *f* of 1.3.

d. An approximately 10 μm thick single layer of a solution of 4% by weight of Lytron 820, 6% by weight of 2,5-bis-(p-diethylaminophenyl)-1,3,4-oxdiazole and 0.25% by weight of Crystal Violet in tetrahydrofuran gives a half-life $T_{1/2}$ of 230 msec and a factor *f* of 1.2.

e. An approximately 10 μm thick single layer of 4% by weight of Lytron 820, 6% by weight of 2,5-bis-(p-diethylaminophenyl)-1,3,4-oxdiazole, 0.1% by weight of Brilliant Green and 0.5% by weight of Rhodamine B extra in glycol monomethyl ether gives a half-life $T_{1/2}$ of 130 msec and a factor *f* = 1.5.

C. Sensitizer intermediate layer:

A comparison example is given to show how relatively low sensitivity is achievable if only the activating sensitizer is present in the base layer.

The base layer used is an approximately 0.3 μm thick layer of Diana Blue (C.I. 21,180) on which is present a 10 μm thick layer of a solution of 8% by weight of a copolymer of styrene and maleic anhydride, 8% by weight of 2,5-bis-(p-diethylaminophenyl)-1,3,4-oxdiazole and 0.1% by weight of Brilliant Green in tetrahydrofuran. A factor *f* of 1.5 is found.

The following examples further illustrate the invention. Percentages are by weight.

EXAMPLES

Using the indicated method A, the following solutions are applied to an electrically conducting carrier — 0.1 to 0.5 μm thick aluminum deposited on 75 to 100 μm thick polyester film — to form approximately 0.1 to 3 μm thick base layers and 5 to 15 μm thick top layers. The following half-lives $T_{1/2}$ or sensitivity factors *f* are found.

| | | |
|---|---|---|
| 1. Base Layer: | | Top Layer: |
| Solution: | 4% of a copolymer of styrene and maleic anhydride (Lytron 820) (STCP)<br>4% of bis-(p-diethylamino-phenyl)-oxdiazole-1,3,4 (OX)<br>0.5% of Rhodamine B extra in glycol monomethyl ether (MG) | Solution: 8% of STCP<br>8% of OX<br>in tetrahydrofuran (THF) |
| $T_{1/2}$ = 136 msec. | | |
| 2. Base Layer: | | Top Layer: |
| Solution: | 4% of STCP<br>6% of OX<br>0.5% of Rhodamine B extra | Solution: 8% of STCP<br>8% of OX |
| Solvent MG | | Solvent THF |
| T½ = 116 msec. | | |
| 3. Base Layer: | | Top Layer: |
| Solution: | 4% of STCP<br>6% of OX<br>0.5% of Rhodamine B extra | Solution: 8% of STCP<br>8% of OX<br>0.1% (relative to OX) of Brilliant Green in THF |
| in MG<br>$T_{1/2}$ = 86 msec; f = 2.15 | | |
| 4. Base Layer: | | Top Layer: |
| Solution: | 4% of STCP<br>6% of OX<br>0.5% of Rhodamine B extra | Solution: 8% of STCP<br>8% of OX<br>0.1% (relative to OX) of Trianisylpyrylium perchlorate in THF |
| in MG<br>$T_{1/2}$ = 92 msec; f = 2.45 | | |
| 5. Base Layer: | | Top Layer: |

-continued

| | | |
|---|---|---|
| Solution: | 4% of STCP<br>6% of OX<br>0.25% of Crystal Violet | Solution: 8% of STCP<br>8% of OX<br>0.1% (relative to OX) of Brilliant Green |
| in MG<br>$T_{1/2}$ = 86 msec; f = 2.7 | | in THF |
| 6. Base Layer: | | Top Layer: |
| Solution: | 4% of STCP<br>6% of OX<br>0.25% of Crystal Violet | Solution: 8% of STCP<br>8% of OX<br>0.1% (relative to OX) of Trianisylpyrylium perchlorate |
| in MG<br>$T_{1/2}$ = 102 msec; f = 2.5 | | in THF |
| 7. Base Layer: | | Top Layer: |
| Solution: | 4% of STCP<br>6% of OX<br>0.53% of Diana Blue | Solution: 8% of STCP<br>8% of OX<br>0.1% (relative to OX) of Brilliant Green |
| in THF<br>$T_{1/2}$ = 172 msec; f = 3.3 | | in THF |
| 8. Base Layer: | | Top Layer: |
| Solution: | 0.2% of STCP<br>0.2% of OX<br>2% of Diana Blue | Solution: 8% of STCP<br>8% of OX<br>0.1% (relative to OX) of Brilliant Green |
| in MG<br>$T_{1/2}$ = 76 msec; f = 3.0 | in THF | |

The layers shown below are produced in accordance with the indicated method B by applying the solutions shown below onto polyester film vapor-coated with aluminum. The half-lives $T_{1/2}$ and sensitivity factors shown below result.

| | | | | |
|---|---|---|---|---|
| 9. | Base Layer: | | Top Layer: | |
| | Solution: | 0.2% of STCP<br>0.2% of OX<br>2% of Diana Blue | Solution: | 8% of STCP<br>8% of OX<br>0.1% (relative to OX) of Brilliant Green |
| | in MG<br>$T_{1/2}$ = 56 msec; f = 4.8 | | in THF | |
| 10. | Base Layer: | | Top Layer: | |
| | Solution: | 0.2% of STCP<br>0.2% of OX<br>2% of dyestuff like Diana Blue (C.I. 21,180) but with methyl groups instead of methoxy groups | Solution: | 8% of STCP<br>8% of OX<br>0.1% (relative to OX) of Brilliant Green |
| | in THF<br>$T_{1/2}$ = 126 msec; f = 3.1 | | in THF | |

Additionally, double layers were produced according to method A and the following values were achieved:

| | | | |
|---|---|---|---|
| 11. Base Layer: | | Top Layer: | |
| Solution: | 0.2% of STCP<br>0.2% of OX<br>2% of Pigment Red 39 | Solution as in Example 10 | |
| in THF<br>$T_{1/2}$ = 96 msec; f = 2.7 | | | |
| 12. Base Layer: | | Top Layer: | |
| Solution: | 4% of STCP<br>6% of OX<br>0.5% of Rhodamine B extra<br>0.1% of trianisylpyrylium perchlorate | Solution as in Example 10 | |
| in MG<br>$T_{1/2}$ = 124 msec; f = 2.5 | | | |
| 13. Base Layer: | | Top Layer: | |
| Solution: | 4% of STCP<br>6% of OX<br>0.1% of Crystal Violet<br>0.1% of trianisylpyrylium perchlorate | Solution as in Example 10 | |
| in MG<br>$T_{1/2}$ = 120 msec; f = 2.7 | | | |
| 14. Base Layer: | | Top Layer: | |
| Solution: | 4% of STCP<br>6% of OX<br>0.05% of Rhodamine B extra<br>0.05% of Crystal Violet<br>0.2% of Brilliant Green | Solution as in Example 10 | |
| in MG<br>$T_{1/2}$ = 128 msec; f = 2.5 | | | |
| 15. Base Layer: | | Top Layer: | |
| Solution: | 0.2% of STCP<br>0.2% of OX | Solution: | 4% of STCP<br>4% of polystyrene |

-continued

| | | | |
|---|---|---|---|
| | 2% of Diana Blue | | 8% of OX<br>0.1% (relative to OX) of Brilliant Green |
| in MG<br>f = 2.7 | | in THF | |
| 16. Base Solution:<br>Solution as in Example 15 | | Top Solution:<br>Solution: | 8% of postchlorinated polyvinyl chloride (Rhenoflex(R) manufactured by Dynamit Nobel)<br>8% of OX<br>0.1% (relative to OX) of Brilliant Green |
| f = 4.2 | | in THF | |
| 17. Base Layer:<br>Solution as in Example 15 | | Top Layer:<br>Solution: | 8% of polyester resin (Dynapol(R), manufactured by Dynamit Nobel)<br>8% of OX<br>0.1% (relative to OX) of Brilliant Green |
| f = 2.8 | | in THF | |
| 18. Base Layer:<br>Solution as in Example 15 | | Top Layer:<br>Solution: | 8.5% of polyester resin Vitel(R) PE 200, manufactured by Goodyear)<br>6.5% of OX<br>0.1% (relative to OX) of Brilliant Green |
| f = 2.4 | | in THF | |
| 19. Base Layer:<br>Solution as in Example 15 | | Top Layer:<br>Solution: | 8.5% of polyester resin (Vitel PE 200)<br>6.5% of OX<br>0.5% (relative to OX) of Brilliant Green |
| $T_{1/2}$ = 132 msec; f = 3.3 | | in THF | |
| 20. Base Layer:<br>Solution: | 0.19% of polyester resin (Vitel PE 200)<br>0.14% of OX<br>2% of Diana Blue | Top Layer:<br>Solution as in Example 19 | |
| in MG<br>f = 2.7 | | | |
| 21. Base Layer:<br>Solution: | 0.2% of STCP<br>0.2% of OX<br>0.4% of Diana Blue<br>1.6% of Pigment Red 39 | Top Layer:<br>Solution as in Example 10 | |
| in MG<br>$T_{1/2}$ = 134 msec; f = 2.8 | | | |
| 22. Base Layer:<br>Solution: | 0.2% of STCP<br>0.2% of OX<br>0.1% of Diana Blue<br>1.9% of Pigment Red 39 | Top Layer:<br>Solution as in Example 10 | |
| in MG<br>$T_{1/2}$ = 114 msec; f = 2.9 | | | |

It will be obvious to those skilled in the art that many modifications may be made within the scope of the present invention without departing from the spirit thereof, and the invention includes all such modifications.

What is claimed is:

1. Electrophotographic recording material comprising an electrically conducting carrier and a photoconducting laminate thereon, the latter comprising a base layer and a top layer each containing the same organic photoconductor and a binder, said top layer containing said photoconductor in an amount of about 40 to 60 percent by weight, and said base layer containing said photoconductor in an amount of about 5 to 10 percent by weight, based upon the weight of the respective layer, said base layer containing a bisazo dyestuff in an amount in the range of about 20 to 90 percent by weight, based upon the weight of the base layer, and said bisazo dyestuff being selected from the group consisting of Diana Blue (C.I. 21,180) having the formula

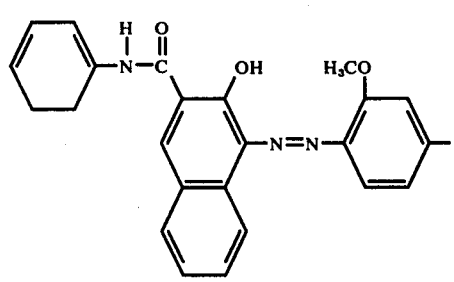

-continued

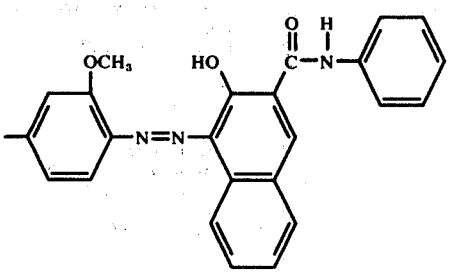

Diana Blue (C.I. 21,180) which is substituted by methy groups instead of methoxy groups and which is a compound corresponding to the formula

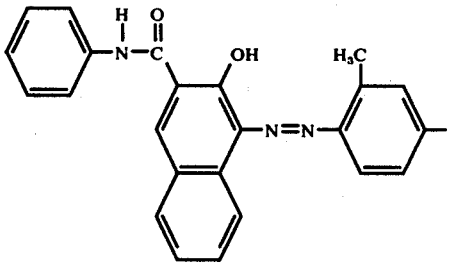

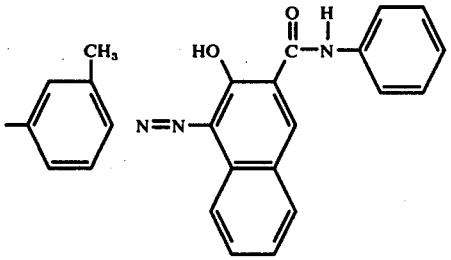

and Pigment Red 39 (C.I. 21,080) having the formula

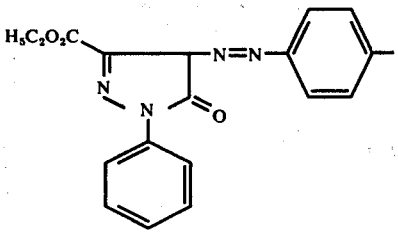

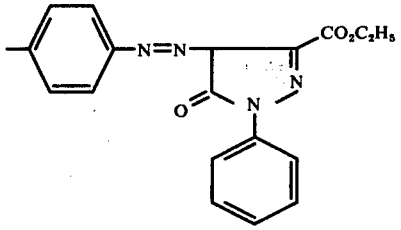

2. Electrophotographic recording material as claimed in claim 1 wherein at least one organic binder is common to the top layer and the base layer.

3. Electrophotographic recording material as claimed in claim 1 wherein the thickness of the top layer is 5 to 15 $\mu$m.

4. Electrophotographic recording material as claimed in claim 1 wherein the thickness of the base layer is 0.1 to 5 $\mu$m.

5. Electrophotographic recording material as claimed in claim 1 wherein the thickness of the base layer is 0.2 to 3 $\mu$m.

6. Electrophotographic recording material as claimed in claim 1 which comprises 2,5-bis-(p-diethylaminophenyl)-1,3,4-oxdiazole as the organic photoconducting substance.

7. Electrophotographic recording material as claimed in claim 1 in which the bisazo dyestuff carries electron attracting groups.

* * * * *

UNITED STATES PATENT AND TRADEMARK OFFICE

CERTIFICATE OF CORRECTION

PATENT NO. : 4,026,704

DATED : May 31, 1977

INVENTOR(S) : Jurgen Rochlitz and Richard Lehner

It is certified that error appears in the above-identified patent and that said Letters Patent are hereby corrected as shown below:

Columns 7 and 8, the material printed in lines 24 and 25, bridging columns 7 and 8, is incorrect and should read as follows:

--- The layers shown below are produced in accordance with the indicated method B by applying the solutions shown below onto polyester film vapor-coated with aluminum. The half-lives $T_{1/2}$ and sensitivity factors shown below result. ---

Columns 7 and 8, the material printed after Example 10 and before Example 11, is incorrect and should read as follows:

--- Additionally, double layers were produced according to method A and the following values were achieved: ---

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarl*